US005671960A

United States Patent [19]

Chyz

[11] Patent Number: 5,671,960

[45] Date of Patent: Sep. 30, 1997

[54] ENGINE BALANCE LIFTER

[75] Inventor: David Chyz, Clinton Township, Mich.

[73] Assignee: Chrysler Corporation, Auburn Hills, Mich.

[21] Appl. No.: 654,490

[22] Filed: May 28, 1996

[51] Int. Cl.[6] ..... B66C 1/10; B66C 13/08

[52] U.S. Cl. ..... 294/81.3; 294/67.5

[58] Field of Search ..... 294/67.1, 67.21, 294/67.3, 67.5, 81.2, 81.3, 81.4, 81.5, 82.12, 86.41

[56] References Cited

U.S. PATENT DOCUMENTS

| | | | |
|---|---|---|---|
| 2,412,488 | 12/1946 | Austin | 294/81.3 |
| 3,146,016 | 8/1964 | Daymon | 294/81.3 |
| 3,995,903 | 12/1976 | Ernst | 294/81.3 |
| 4,431,223 | 2/1984 | Miller | 294/81.4 |
| 4,597,602 | 7/1986 | McGriff | 294/81.3 |
| 4,685,714 | 8/1987 | Hoke | 294/81.2 |

FOREIGN PATENT DOCUMENTS

| | | | |
|---|---|---|---|
| 1058551 | 3/1954 | France | 294/81.3 |
| 2529068 | 1/1977 | Germany | 294/81.3 |

*Primary Examiner*—Johnny D. Cherry
*Attorney, Agent, or Firm*—Edward A. Craig

[57] ABSTRACT

An engine balance lifter has a main beam and two cross beams. The cross beams are secured to the main beam in spaced-apart relation at selected points along the length of the main beam and in selected angular positions with respect to the main beam. Clamps adjacent the ends of the cross beams can be bolted onto the engine to lift the engine out of the engine compartment or to install it. A suspension hanger supports the main beam at a selected point along the length of the main beam.

4 Claims, 5 Drawing Sheets

ENGINE BALANCE LIFTER

FIELD OF INVENTION

This invention relates generally to lifting devices and more particularly to a device for installing and removing automobile engines.

BACKGROUND AND SUMMARY OF THE INVENTION

The installation and removal of engines particularly in late model automobiles is time consuming and sometimes requires the removal of the front body panels, body structure, and core support. Often the engine must be tilted before it can be removed or installed. What is needed is an engine balance lifter which is fully adjustable and capable of tilting the engine as necessary to accomplish removal and/or installation without requiring removal of any body panels or other body structure.

In accordance with the present invention, an engine balance lifter is provided which has a longitudinally extending main beam and two laterally extending cross beams. The cross beams are mounted to the main beam in spaced-apart relation at selected points along the length of the main beam, and preferably are capable of being pivotally adjusted. Engine clamps adjacent to the ends of the cross beams are preferably secured to the cross beams in adjusted positions for convenient attachment to the engine. A suspension hanger is provided for supporting the main beam and preferably the suspension hanger is adjustable along the length of the main beam so that the balance lifter can be tilted while suspended, as may be necessary to install or remove the engine. After the clamps are secured to the engine, they are tightly secured to the cross beams, the cross beams are tightly secured to the main beam and a crane or other suitable device is hooked to the suspension hanger to raise and lower the engine either for removal from a vehicle or for installation.

To move the point of attachment of the hanger to the main beam, an elongated screw extending lengthwise of the main beam is preferably provided. The screw is rotatably attached to the ends of the main beam. The screw threads through a nut carried by the hanger so that rotation of the screw moves the hanger to any selected point along the length of the main beam. A drive impact gun may be provided for turning the screw.

One object of this invention is to provide an engine balance lifter having the foregoing features and advantages.

Another object is to provide an engine balance lifter which is constructed of a few simple parts, is rugged and durable in use, is readily and fully adjustable, is easy to manufacture and can be readily operated.

These and other objects, features and advantages of the invention will become more apparent as the following description proceeds, especially when considered with the accompany drawings.

DETAILED DESCRIPTION OF THE PREFERRED EMBODIMENTS

Referring now more particularly to the drawings, the engine balance lifter 12 is shown in FIGS. 1–3 and 8–10 attached to an engine 14 of an automobile 16 for raising the engine out of the engine compartment 17 or lowering it into an installed position in the engine compartment.

Figure 1:
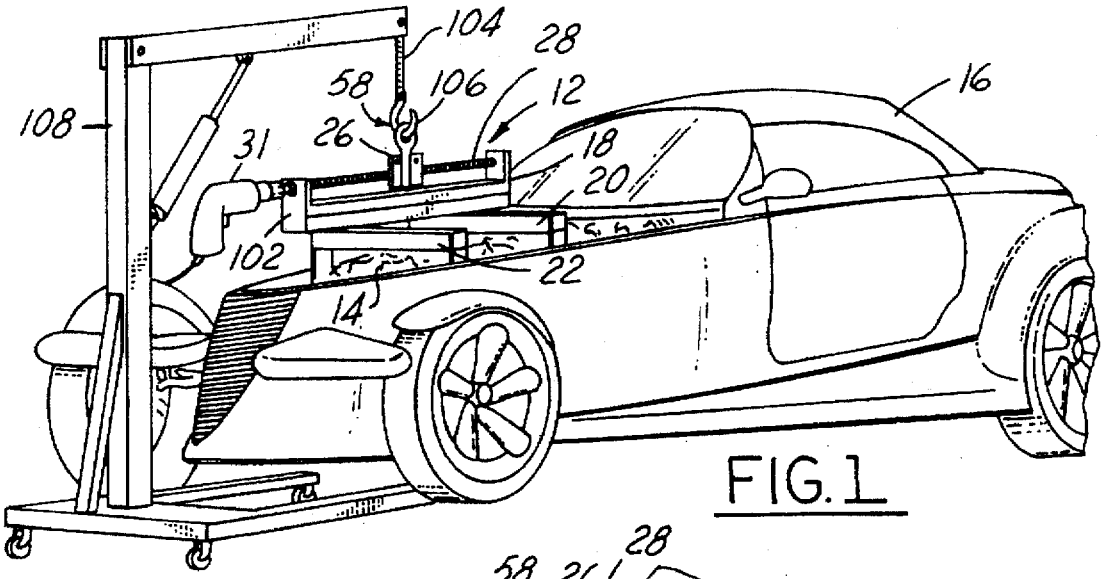
FIG. 1 is a perspective view of an automobile showing an engine balance lifter constructed in accordance with the invention in a position to remove or install the automobile engine.
Figure 2:
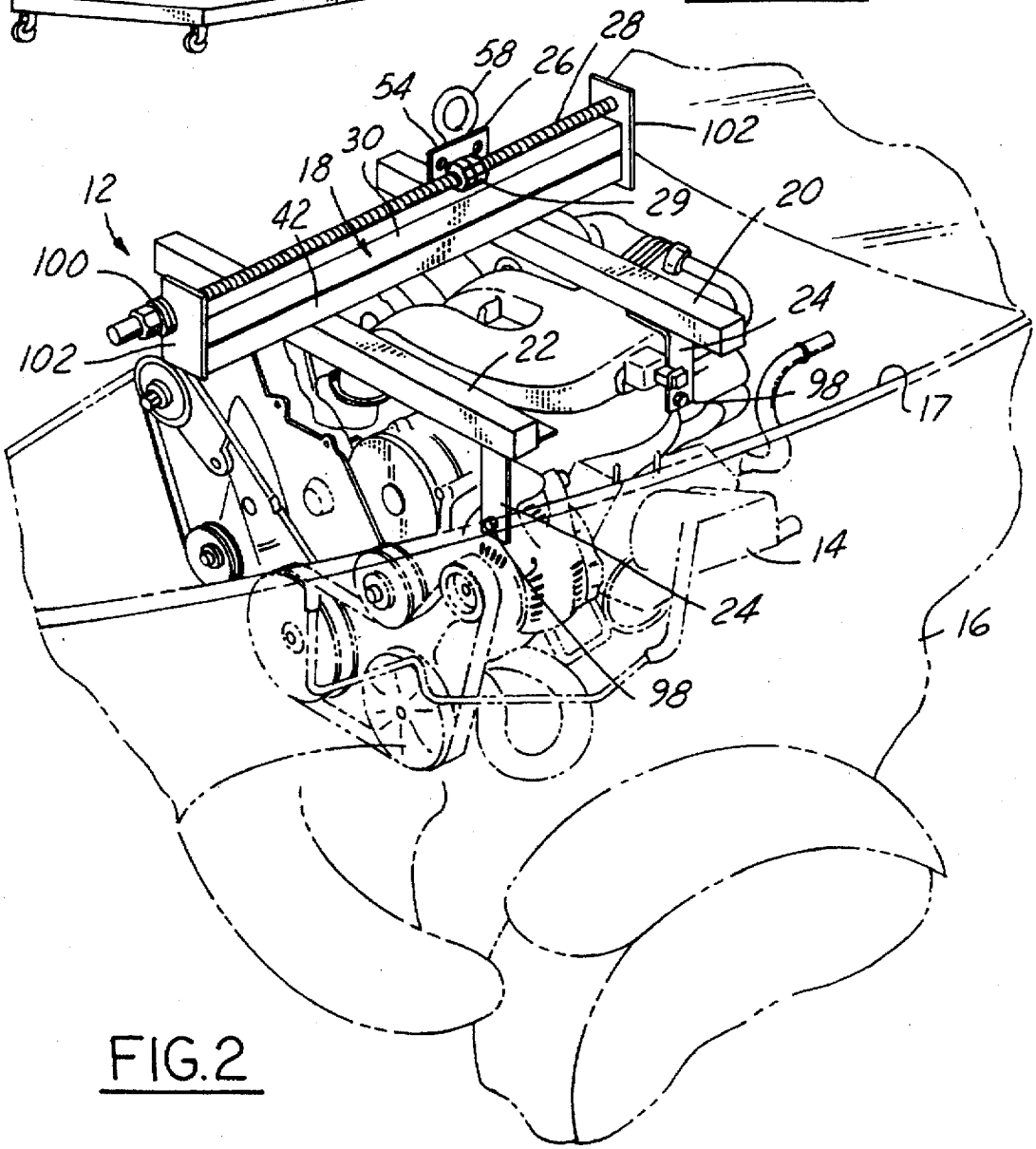
FIG. 2 is an enlarged view showing the engine balance lifter of the invention attached to an engine within the engine compartment of the automobile.
Figure 3:
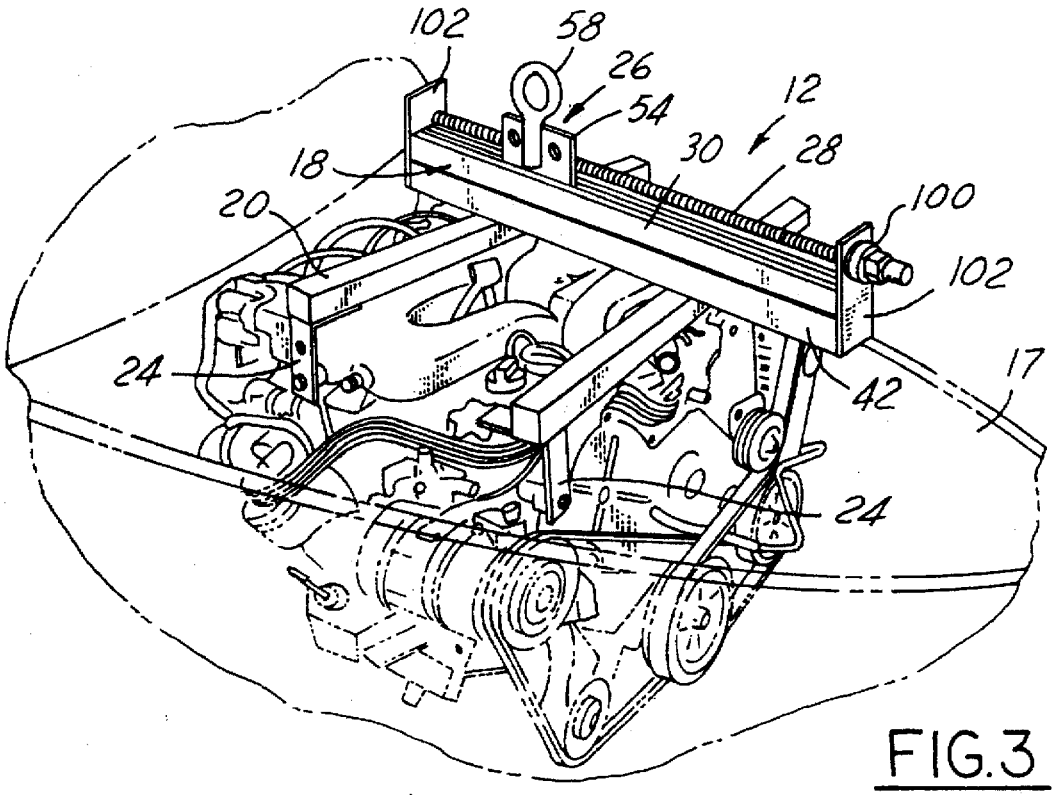
FIG. 3 is a perspective view of the structure shown in FIG. 2, but as seen from the opposite side of the vehicle.
Figure 4:
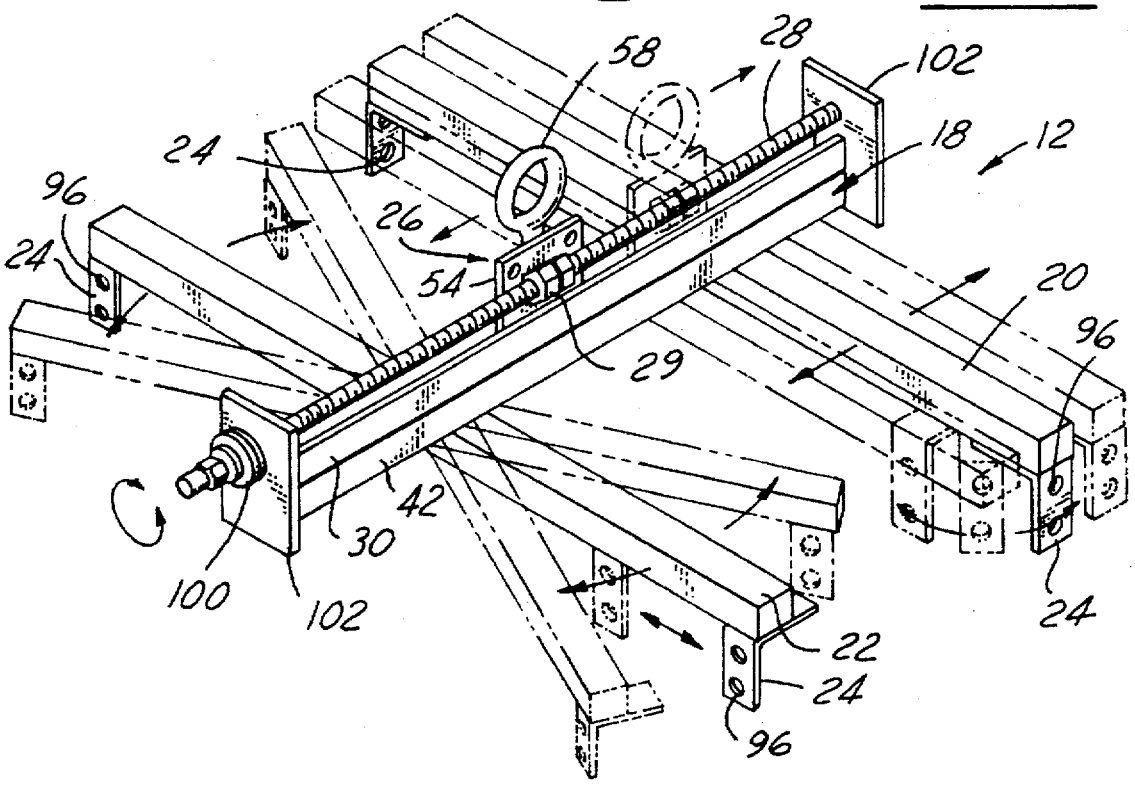
FIG. 4 is a perspective view of the engine balance lifter showing several positions of the cross beams and suspension hanger.

The lifter 12 comprises an elongated, longitudinally extending main beam 18, elongated, laterally extending cross beams 20 and 22, clamps 24 adjacent the ends of the cross beams, and a suspension hanger 26 which supports the main beam (see FIG. 4). The hanger 26 can be moved along the length of the main beam to support it at selected points. A screw 28 extends lengthwise of the main beam and threads through a nut 29 on the hanger so that when the screw is rotated, the hanger is moved lengthwise of the main beam. The screw may be rotated by a drive impact gun 31.

Figure 6:
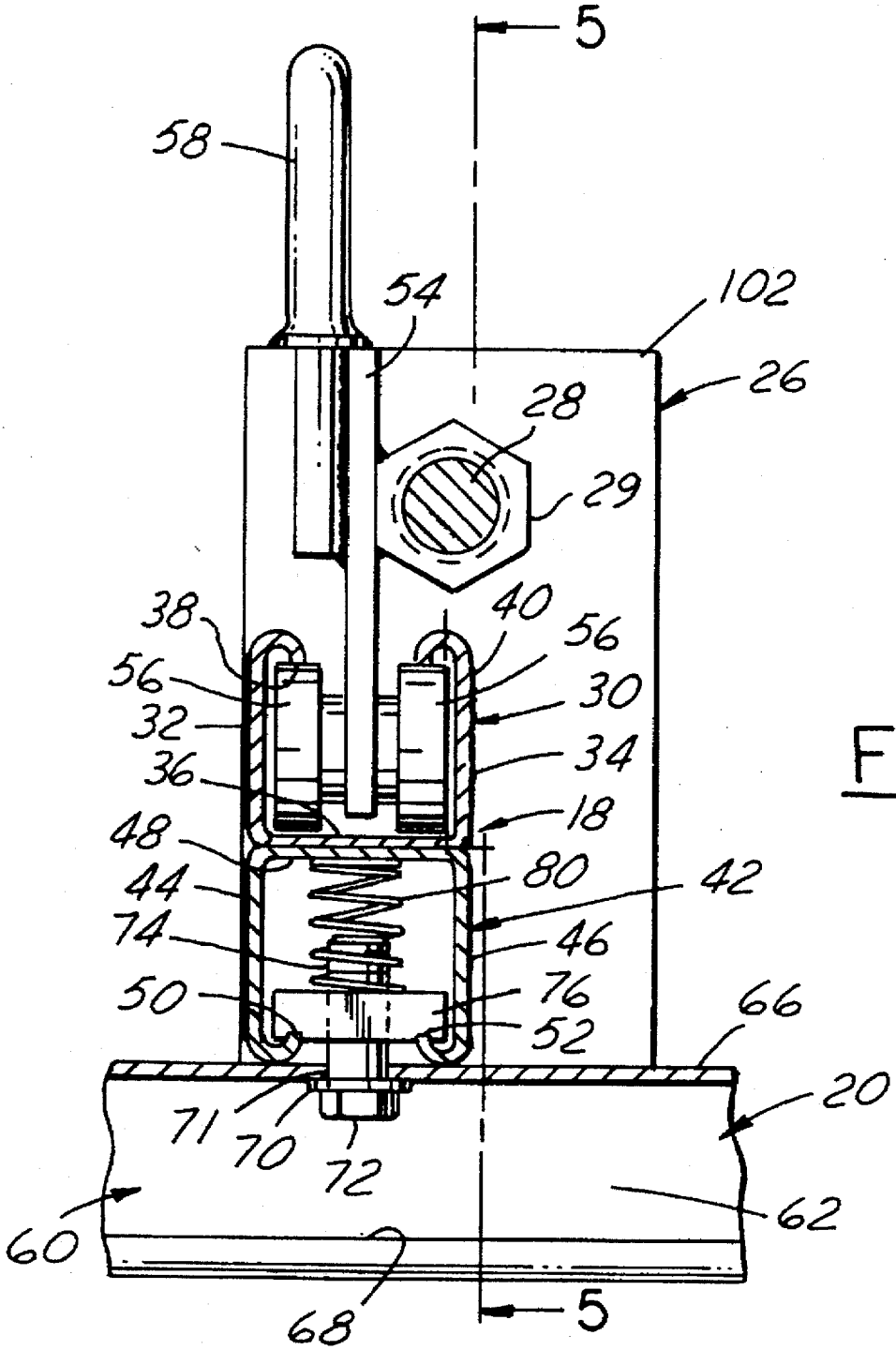
FIG. 6 is a sectional view taken on the line 6—6 in FIG.
Figure 8:
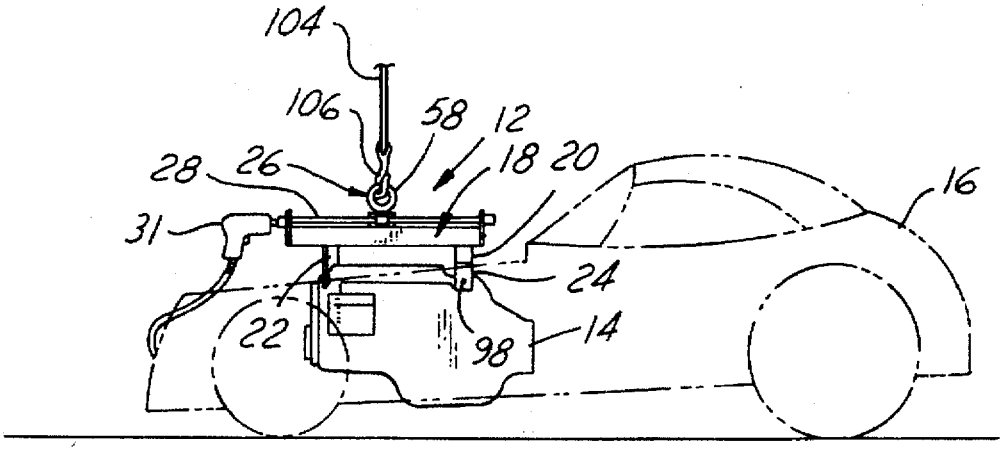
FIG. 8 is a side elevational view showing the engine balance lifter of this invention supporting an engine within the engine compartment of an automobile, the automobile being shown in phantom lines, but the engine balance lifter and engine being shown in solid lines.
Figure 9:
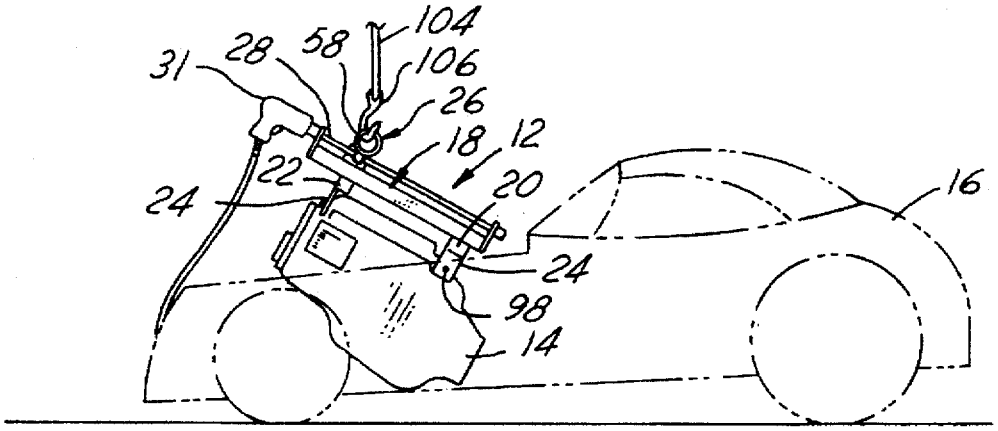
FIG. 9 is a view similar to FIG. 8, but shows the engine tilted and partially lifted out of the engine compartment.
Figure 10:
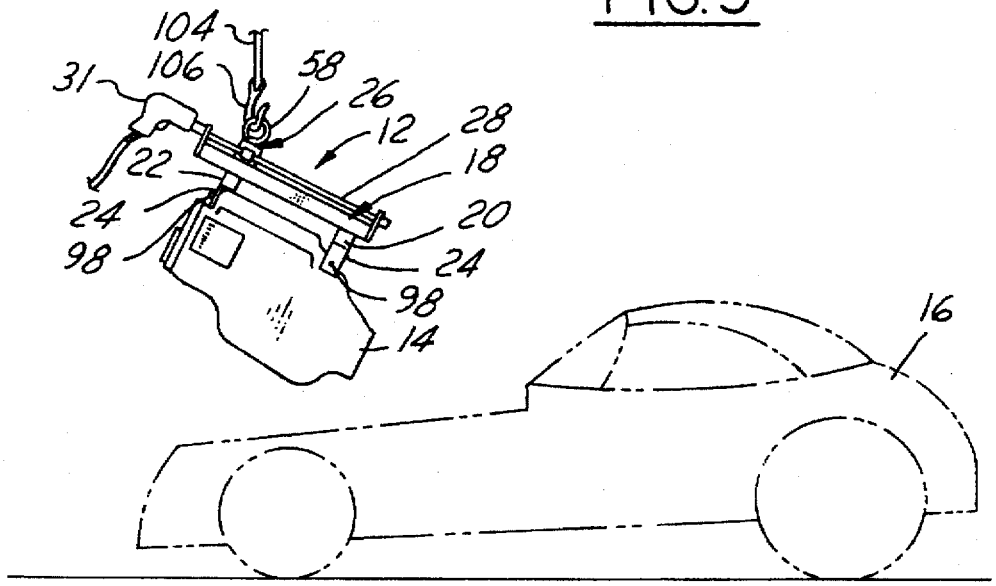
FIG. 10 is a view similar to FIGS. 8 and 9, but shows the engine raised above the automobile.

The main beam 18 comprises an elongated channel 30 having laterally spaced, parallel, upwardly extending side walls 32 and 34 and a base 36 perpendicular to the side walls (see FIG. 6). The top edges of the side walls 32 and 34 are turned inwardly to provide downwardly extending laterally spaced parallel tracks 38 and 40. The main beam 18 also has an elongated channel 42 of inverted cross section, having laterally spaced downwardly extending side walls 44 and 46 with a base 48 perpendicular to the side walls. The lower edges of the side walls are turned inwardly to provide upwardly extending laterally spaced parallel tracks 50 and 52. The channels 30 and 42 are co-extensive with one another and their bases are rigidly secured together as by welding.

The hanger 26 comprises a plate 54 which extends down into the channel 30. Rollers 56 are journalled on the lower edge portion of the plate 54 and are disposed in the channel 30 and run on the tracks 38 and 40. The hanger also has an annular, ring-shaped hook or eye 58 welded to the top of the plate 54.

Figure 5:
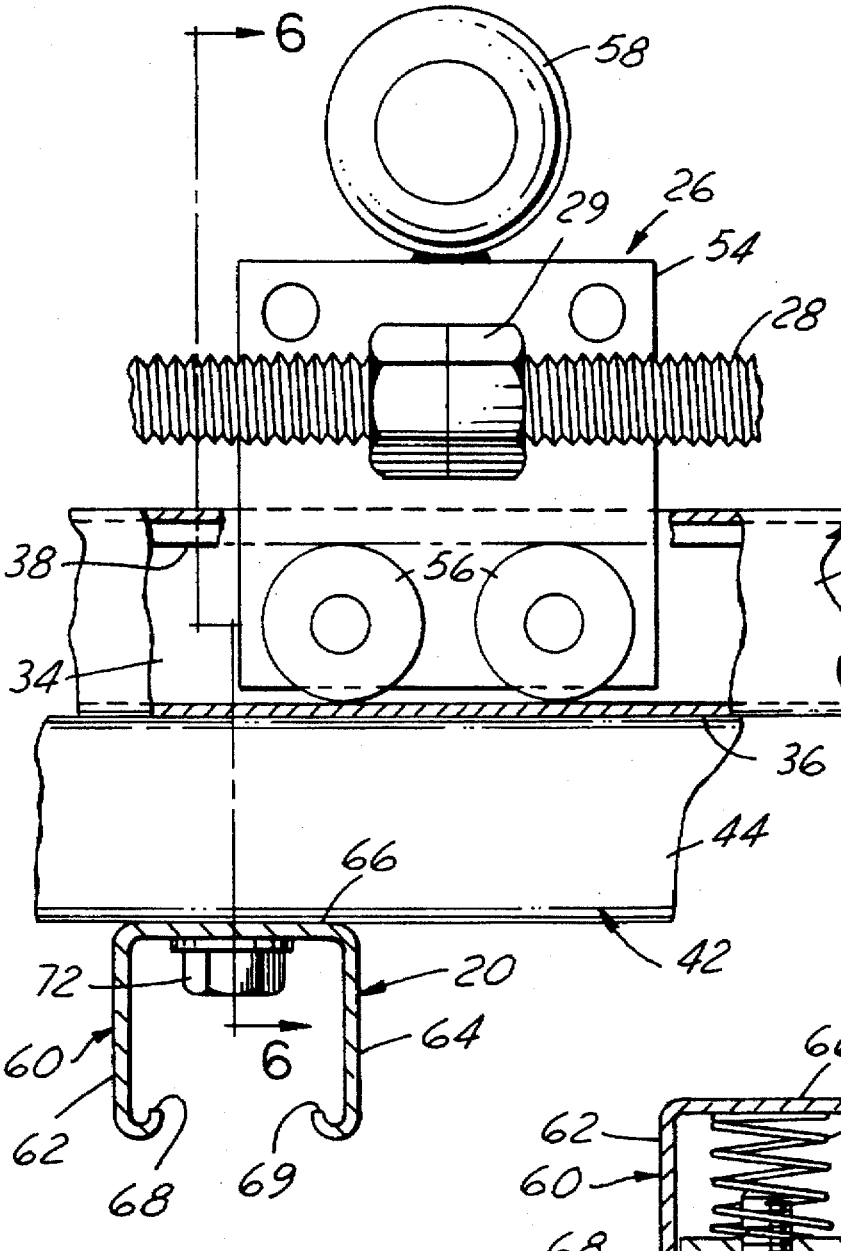
FIG. 5 is an enlarged fragmentary view of a portion of the engine balance lifter with parts in section and parts in elevation and taken on the line 5—5 in FIG. 6.
Figure 7:
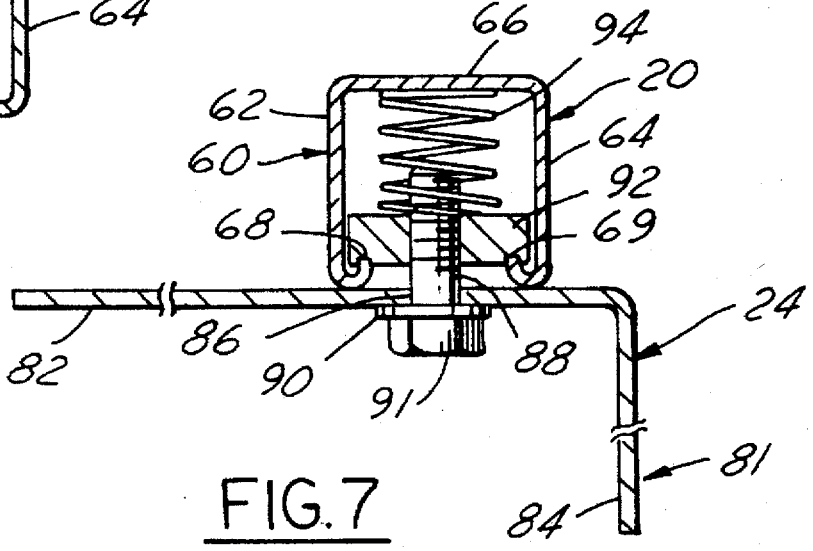
FIG. 7 is a fragmentary view showing the connection of one of the engine clamps to a cross beam.

The cross beams 20 and 22 each comprises an elongated channel 60 (FIGS. 5–7). The channel 60 is of inverted cross section and has laterally spaced parallel downwardly extending side walls 62 and 64 and a base 66 perpendicular to the side walls. The bottom edges of the side walls are turned inwardly to provide upwardly extending laterally spaced tracks 68 and 69. Each cross beam has a bolt 70 rotatable in a hole 71 in the base of the channel. The hole 71 is preferably at the midpoint in the length of the channel 60. The bolt 70 has a head 72 within the channel and a threaded shank 74 extending upwardly through the hole 71 and into the channel 42 of the main beam. A nut 76 within the channel 42 is threaded on the shank 74 of the bolt. A coil spring 80 is compressed between the nut 76 and the base 48 of the channel 42 to press the nut down on the tracks 50 and 52 as shown in FIG. 6. The nut 76 has grooves in its lower surface into which the tracks 50 and 52 extend so that the nut can slide along these tracks for adjustment purposes but without rotating. When the bolt 70 is loose, the cross beam can rotate on the bolt but when the bolt is tightened, the base of the channel 60 of the cross beam is drawn up tightly against the side flanges of the channel 42 and the nut 76 is drawn down tightly on the tracks 50 and 52 so that the cross beam is frictionally held at a selected position along the channel 42 of the main beam and is frictionally held from rotating relative to the main beam. In this manner, the cross beams may be secured to the main beam in selected positions along the length of the main beam, and at a desired angle of rotation with respect to the main beam.

Each clamp 24 comprises an angle member 81 having a horizontal flange 82 and a vertical flange 84 (FIG. 7). The horizontal flange 82 has a hole 86 in which the threaded shank 88 of a bolt 90 is rotatably received. The bolt shank extends upwardly into the channel 60 of a cross beam where it threads into a nut 92 within the channel. The nut 92 has grooves in its undersurface in which the tracks 68 and 69 are engaged to prevent the nut from rotating, and a coil spring 94 presses the nut down on the tracks. When the bolt is loosened, the angle member 81 may be turned to any angle about the axis of the bolt shank, but when the bolt is tightened, the horizontal flange 82 of the angle member is drawn up by bolt head 91 tight against the lower edges of the cross beam channel 60 and the nut 92 is drawn down tightly upon the tracks so that the angle member is frictionally held against rotation and is frictionally held in a selected position of adjustment along the length of the cross beam, preferably adjacent an end thereof. All four clamps are of the same construction and are secured adjacent to the ends of the cross beams in the same manner. The vertical flange 84 of each angle member has one or more holes 96 for receiving a threaded bolt 98 to bolt onto the engine.

The ends of the screw 28 are mounted for rotation in bearings 100 in brackets 102 secured to the ends of the main beam 18.

In use, the clamps 24 are fastened to the engine by the bolts 98. The clamps are secured in adjusted position to the cross beams 20 and 22 by tightening bolts 90. The cross beams 20 and 22 are secured to the main beam 18 in the desired spaced apart relation and at a selected angle by tightening the bolts 70, and the hanger 26 is moved to a selected position along the length of the main beam by rotating the screw 28 by the drive impact gun 31. The position of the hanger determines the tilt of the lifter and engine. A cable 104 with a hook 106 for engaging the eye 58 of the hanger may be used to raise or lower the lifter and hence the engine. The cable 104 is reeled in and paid out by a suitable power device on a movable stand 108.

The clamps 24 and cross beams 20 and 22 are fully adjustable as needed to clamp onto the particular engine being moved. The hanger 26 can be moved to the desired position lengthwise of the main beam to tilt the engine the amount needed to move it into or out of the engine compartment. The engine can be removed or installed by a direct vertical movement without the necessity of removing any automobile body panels or other body structure.

What is claimed is:

1. An engine balance lifter comprising an elongated, longitudinally extending main beam, first and second elongated, laterally extending cross beams, means mounting said cross beams on said main beam in spaced apart relation at selected points along the length of said main beam and at selected angular positions with respect to said main beam, first and second engine clamps for said first cross beam and third and fourth engine clamps for said second cross beam, mean securing said first and second clamps to said first cross beam in spaced relation at selected points along the length of said first cross beam, means securing said third and fourth clamps to said second cross beam in spaced relation at selected points along the length of said second cross beam, means on each said clamp adapted for removable attachment to an engine, and a suspension hanger having mean supporting said main beam at selected points along the length of said main beam, said main beam comprising an elongated channel of inverted cross-section having side flanges terminating in laterally inwardly turned, spaced-apart, parallel tracks, said means mounting said cross beams on said main beam comprising a first bolt rotatably mounted on said first cross beam and a second bolt rotatably mounted on said second cross beam, a first nut in said channel slidably engaging said tracks and threaded on said first bolt, and a second nut in said channel slidably engaging said tracks and threaded on said second bolt, whereby tightening said bolts in said nuts will clamp said cross beams to said channel at selected points along the length of said main beam and in desired angular positions with respect to said main beam.

2. An engine balance lifter comprising an elongated, longitudinally extending main beam, said main beam comprising a first elongated channel having side flanges terminating in laterally inwardly turned, spaced-apart, parallel first tracks, said main beam also comprising a second elongated channel of inverted cross section which is parallel to and co-extensive with said first channel and has side flanges terminating in laterally inwardly turned, spaced-apart, parallel second tracks, first and second elongated, laterally extending cross beams, said first cross beam comprising a third elongated channel of inverted cross section having side flanges terminating in laterally inwardly turned, spaced-apart, parallel third tracks, said second cross beam comprising a fourth elongated channel of inverted cross section having side flanges terminating in laterally inwardly turned, spaced-apart, parallel fourth tracks, means mounting said cross beams on said main beam in spaced-apart relation at selected points along the length of said main beam for pivotal movement, said means mounting said cross beams on said main beam comprising a first bolt rotatably mounted on the third channel of said first cross beam and a second bolt rotatably mounted on the fourth channel of said second cross beam, a first nut in said second channel slidably engaging said second tracks and threaded on said first bolt, a second nut in said second channel slidably engaging said second tracks and threaded on said second bolt, whereby tightening said bolts in said nuts will clamp the third and fourth channels of said respective first and second cross beams to said second channel at selected points along the length of said main beam and in selected angular positions with respect to said main beam, first and second engine clamps for said first cross beam and third and fourth engine clamps for said second cross beam, means securing said first and second clamps to said third channel of said first cross beam in spaced relation at selected points along the length thereof, means securing said third and fourth clamps to said fourth channel of said second cross beam in spaced relation at selected points along the length thereof, means on each said clamp adapted for removable attachment to an engine, a suspension hanger having means supporting said main beam, said means supporting said main beam comprising rollers on said hanger disposed within said first channel and engaging said first tracks, and means for positioning said hanger lengthwise of said main beam at a selected point along the length of said main beam.

3. An engine balance lifter as set forth in claim 2, wherein said means for positioning said hanger comprises an elongated screw extending lengthwise of said main beam, said hanger having a fixed nut threadedly engaging said screw, and said main beam having ends provided with means supporting bearings rotatably mounting said screw so that rotation of said screw will move said hanger lengthwise of said main beam.

4. An engine balance lifter as set forth in claim 3, wherein said means securing each of said clamps to the channel of the associated cross beam comprises a third bolt rotatably connected to each said clamp, and a third nut in the channel of the associated cross beam slidably engaging the tracks thereof threaded on said third bolt, whereby tightening said third bolts in said third nuts will secure said clamps to the channels of the associated cross beam at selected points along the length thereof and in selected angular positions with respect thereto.

* * * * *